US005509347A

United States Patent [19]

de Jong et al.

[11] Patent Number: 5,509,347

[45] Date of Patent: Apr. 23, 1996

[54] RADIAL PISTON PUMP

[75] Inventors: Leendert W. C. de Jong, Oldenzaal; Arjan P. van Heiningen, Haaksbergen; Willem H. Masseling, Oldenzaal, all of Netherlands

[73] Assignee: Applied Power Inc., Butler, Wis.

[21] Appl. No.: 381,835

[22] PCT Filed: Jun. 13, 1994

[86] PCT No.: PCT/NL94/00140

§ 371 Date: Feb. 7, 1995

§ 102(e) Date: Feb. 7, 1995

[87] PCT Pub. No.: WO94/29591

PCT Pub. Date: Dec. 22, 1994

[30] Foreign Application Priority Data

Jun. 11, 1993 [NL] Netherlands ..... 9301011

[51] Int. Cl.[6] ..... F01B 1/00

[52] U.S. Cl. ..... 92/72; 417/273

[58] Field of Search ..... 92/12.1, 72; 91/491; 417/273

[56] References Cited

U.S. PATENT DOCUMENTS

| | | | |
|---|---|---|---|
| 3,968,736 | 7/1976 | Pecorari | 92/72 |
| 5,295,797 | 3/1994 | Kahrs et al. | 92/72 |

FOREIGN PATENT DOCUMENTS

| | | | |
|---|---|---|---|
| 690221 | 3/1940 | Germany . | |
| 1928853 | 12/1970 | Germany . | |
| 1653643 | 11/1971 | Germany . | |
| 2305130 G 8S 13 | 8/1973 | Germany | 92/72 |
| 278.1 | 4/1990 | Germany . | |
| 575319 | 2/1946 | United Kingdom . | |
| 627844 | 8/1949 | United Kingdom | 92/72 |
| 1303732 | 1/1973 | United Kingdom . | |

*Primary Examiner*—Thomas E. Denion
*Attorney, Agent, or Firm*—Quarles & Brady

[57] ABSTRACT

A radial piston pump of the type, in which an excentric rotor (7) is adapted to cause the pistons (4) to perform a reciprocating movement within radial cylinders (3) in the pump body (1), the radial inner ends of the pistons (4) being each provided with a broadened foot (6), said broadened feet (65) being kept in contact with the rotor (7) also during the suction strokes of the respective pistons (4) by means of a coupling ring (26) of a substantially L-shaped cross section, the axial ring portion (**26*a*) of which engages the radial outer end faces of the broadened feet (6) and the radial portion (26*b*) of which keeps said ring (26) axially in place. According to the invention the coupling ring (26) has its radial portion (26*b*) bearing loosely against a radial sliding surface, while the broadened feet (6) at the radial inner piston ends are in the shape of heads which are integrally formed with the respective pistons (4), the free end faces of said heads, as well as the end faces adjoining the respective pistons (4) being spherically shaped, the axial portion of the coupling (26**) having an inner circumferential surface of a slightly conically widening shape.

1 Claim, 1 Drawing Sheet

RADIAL PISTON PUMP

FIELD OF THE INVENTION

The invention relates to a radial piston pump of the type, in which an eccentric rotor is adapted to cause the pistons to perform a reciprocating movement within radial cylinders in the pump body, the radial inner ends of the pistons being each provided with a broadened foot, said broadened feet being kept in contact with the rotor also during the suction strokes of the respective pistons by means of a coupling ring of a substantially L-shaped cross-section, the axial ring portion of which engages the radial outer end faces of the broadened feet and the radial portion of which keeps said ring axially in place.

Discussion of the Prior Art

Such a pump is known from German Offenlengungsschrift 1.928.853.

With this well-known pump the broadened feet at the radial inner piston ends are formed by sliding shoes which are pivotally connected to the respective piston ends. The effective sliding surfaces of said sliding shoes are shaped to conform with the cylindrical surface of the rotor and the cylindrical inner circumferential surface of the axial ring portion of the coupling ring respectively. The coupling ring has its radial portion fixedly connected to the rotor. The sliding shoes, which are stationary as seen in the direction of rotation, are thus slidingly guided with an inner and an outer cylindrical sliding surface between two concentric cylindrical surface portions of the rotor and of the coupling ring respectively. This means, that a considerable frictional resistance has to be overcome, said frictional resistance being further increased by the friction in the pivot connection between the pistons and the sliding shoes.

SUMMARY OF THE INVENTION

The invention therefore aims at providing a pump of the above type, with which the frictional resistance to be overcome in operation, is substantially reduced.

According to the invention this aim is achieved in that the coupling ring has its radial portion bearing loosely against a radial sliding surface, while the broadened feet at the radial inner piston ends are in the shape of heads which are integrally formed with the respective pistons, the free end faces of said heads, as well as the end faces adjoining the respective pistons being spherically shaped, the axial portion of the coupling having an inner circumferential surface of a slightly conically widening shape.

Due to the measures according to the invention the areas of contact between the mutual sliding surfaces of the pistons, the coupling ring and the rotor are substantially reduced to point and line contacts, whereas the movements of the coupling ring will in practise be limited to a translational movement of a small amplitude relative to the stationary radial sliding surface. Moreover, the end faces of the piston heads adjoining the pistons may rock on the inner circumferential surface of the axial portion of the coupling ring.

The omission of a pivot connection between the pistons and the heads of the same not only avoids the friction involved with such pivot connection but also leads to a simpler construction.

It is to be noted, that German Offenlegungsschrift 1.653.643 discloses a radial piston pump, wherein the radial inner piston ends are also provided with an intergrally formed widened head, the free end face of which is of a spherical shape. With this embodiment, however, the annular end faces adjoining the respective pistons are flat in shape, while the coupling ring has at its inner circumference an arcuate portion (turned with its convex side towards the axis of the pump) at the location of each piston head, said arcuate portions engaging the flat annular end faces of the respective piston heads.

A disadvantage of this well-known construction is that the coupling ring may, in addition to the required translational movement, easily make an undesired rotational movement relative to the pistons, as a result of which the widened heads may get jammed between rotor and coupling ring.

The invention will be hereinafter further described by way of example with reference to the accompanying drawing.

DETAILED DESCRIPTION OF THE PREFERRED EMBODIMENT

The annular pump body 1 is surrounded by an annular wall member 2 and has a number of radially directed pumping cylinders 3, in which pistons 4 are mounted for a reciprocating movement.

Figure 1:
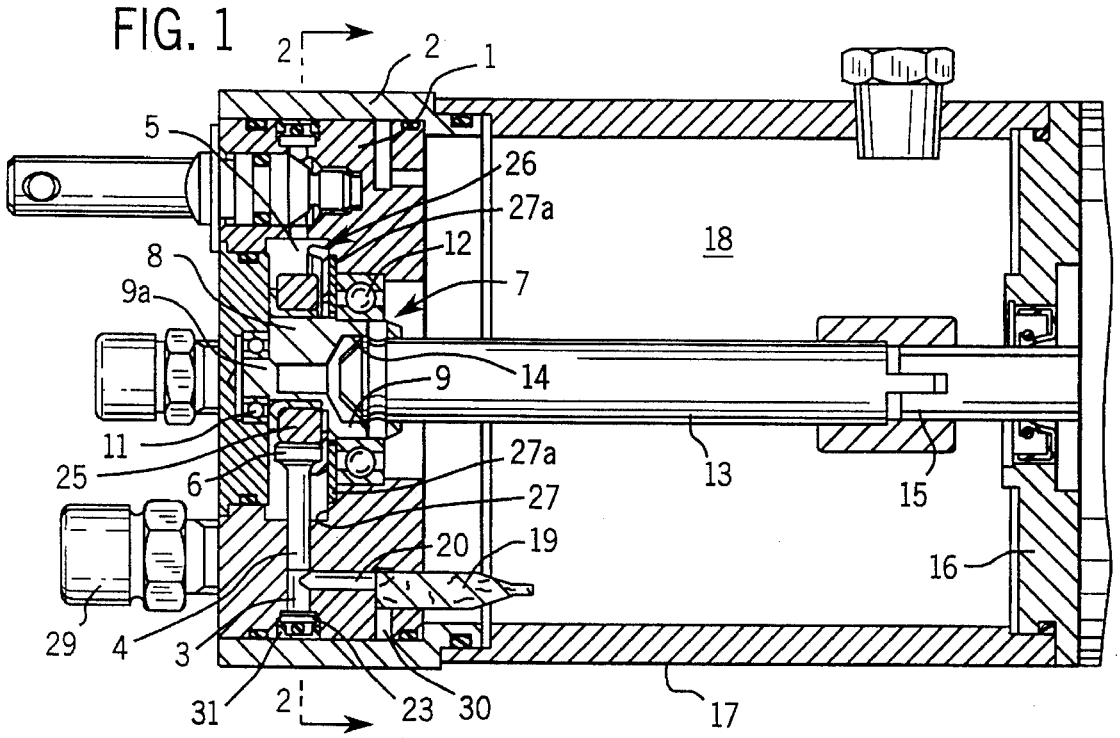
FIG. 1 shows an axial cross-sectional view through a radial piston pump according to the invention, as seen along the line I—I in FIG. 2.
Figure 3:
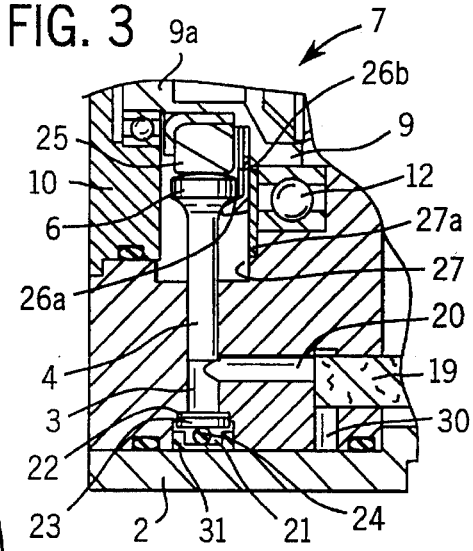
FIG. 3 is an enlarged longitudinal cross-sectional view through the left lower part of the device of FIG. 1.

The pump body 1 confines a central space 5, into which the radial inner ends project and which also accommodates the eccentric part 8 of the rotor 7; the radial inner piston ends broaden into heads 6. One end (i.e. the left end as seen in FIG. 1) of the central space 5 (FIG. 3) is closed by a cover 10 and at a distance from the latter within the pump body 1 ball bearings 11 and 12 are provided, in which the centric portion 9, 9*a* of the rotor 7 is journalled.

13 designates a connection shaft, made e.g. of a suitable artificial resin, one end of which non-rotatably engages a central bore 14 in the centrical portion 9 of the rotor 7 and the other end of which non-rotatably engages the drive shaft 15 of the pump engine (electric motor) 16.

The space between the pump body 1 and the housing of the electric motor 16 is radially outwardly confined by a shell 17, which is an extension of the annular wall member 2 and constitutes the outer wall of a reservoir 18 for the liquid to be pumped. Liquid may flow from the reservoir 18 through a filter 19 into a suction passage 30 and through suction openings 20 into each of the cylinders 3; the suction passage 30 is constituted by a circumferential groove of a relatively large depth.

The radial outer ends of the cylinders 3 merge into a circumferential passage 21 that is provided in the outer wall of the pump body 1. The connecting openings between the cylinders 3 and the circumferential passage 21 are broadened into chambers 22 for disc-shaped pressure valves 23. The pressure valves 23 are pressed on their seats by means of a common resilient closure element, that is received within the circumferential passage 21 and is constituted by a tangentially pre-stressed O-ring 24; the tangential pretension of the ring 24 produces a radially inwardly directed closing force on each of the pressure valves 23.

Figure 2:
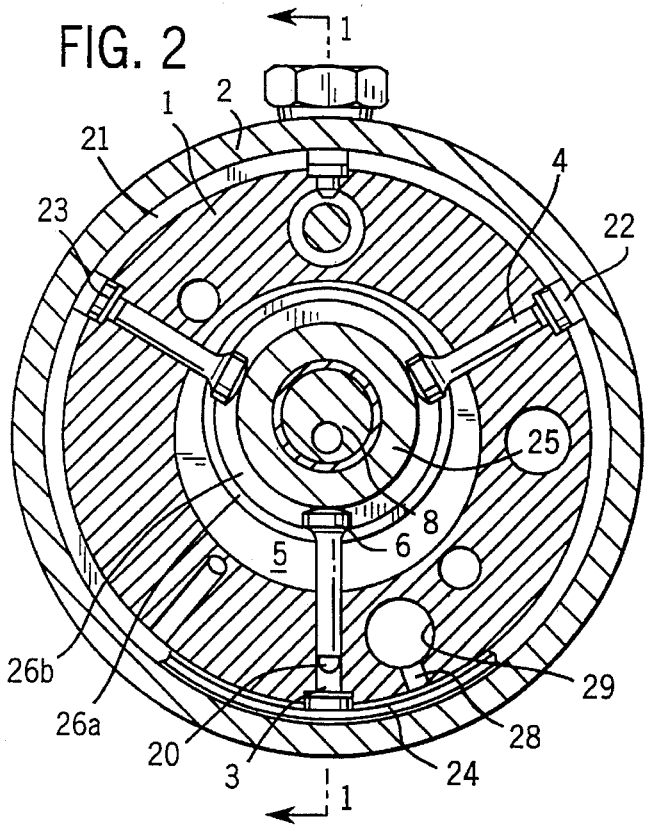
FIG. 2 represents a cross-section along the line II—II in FIG. 1.

The circumferential passage 21 is radially outwardly closed by an annular member 31 of plastics material, having at its circumferential inner surface a groove for receiving the O-ring 24; a radially directed connecting passage 28 (FIG. 2), which may be selected rather arbitrarily, connects the circumferential passage 21 to a connection 29 for a pressure line that is provided on the end wall of the pump body 1.

The effective outer circumferential portion of the eccentric rotor part 8 is formed by a slide bearing ring 25 mounted on said rotor part. While the rotor 7 is rotating the slide bearing ring 25 will remain stationary relative to the eccentric rotor part 8, so that it will merely perform a translational movement relative to the pump body 1.

The pistons have their radial inner ends 6 engaging the ring 25 and are caused by the rotating rotor 7 to reciprocate within the respective cylinders. Each time the rotor will cause a piston to move radially outwardly so as to perform a pressure stroke, whereby the respective pressure valve 23 is lifted from its seat against the radially inwardly directed closure force of the O-ring 24, while another piston is performing an inwardly directed suction stroke so as to extract liquid (e.g. hydraulic fluid) from the reservoir 18 through the respective suction opening 20 via the suction passage 30 and the filter 19 (while the respective pressure valve is kept closed).

To perform a suction stroke the pistons will have to follow the eccentric rotor part 8, which means that the contact between the radial inner piston ends and the rotor part 8 (i.e. the slide bearing ring 25) must be maintained. In accordance with the present invention this is achieved in a simple and effective manner by means of a loosely mounted coupling ring 26.

An axially directed ring portion **26*a* of the coupling ring 26 engages the outwardly facing end faces of the heads 6 and thereby keeps said heads in contact with the ring 25 of the eccentric rotor part 8. An annular disc portion 26*b* is connected with the ring portion 26*a* and is positioned in a plane at right angles to the pump axis; this annular disc portion 26*b* is loosely positioned between the right- and end face (as seen in the drawing) of the slide bearing ring 25 and the opposite end face 27 of the pump body 1 or a filling ring 27*a* lying flush therewith respectively. The coupling ring 26, which may be formed of a suitable artificial resin, is coaxially positioned relative to the eccentric rotor part 8 and is performing, in operation, a translational movement together with the slide bearing ring 25 relative to the stationary pump body 1**.

The coupling ring 26 could also be mounted on the opposite side of the bearing 25. In that case the annular disc portion **26*b* would become loosely positioned between the left end surface of the slide bearing ring 25 and the inner side of the cover 10**.

We claim:

1. A radial piston pump of the type in which an eccentric rotor is adapted to cause pistons to perform a reciprocating movement within radial cylinders in a pump body, radial inner ends of said pistons being each provided with a broadened foot, said broadened feet being kept in contact with said rotor also during suction strokes of said respective pistons by means of a coupling ring of a substantially L-shaped cross-section, said coupling ring having an axial ring portion which engages radial outer end faces of said broadened feet and having a radial portion which keeps said ring axially in place, characterized in that said radial portion of said coupling ring bears loosely against a radial sliding surface, and said broadened feet at said radial inner piston ends are in the shape of heads which are integrally formed with the respective pistons, free end faces of said heads and end faces of said heads adjoining the respective pistons being spherically shaped, and an axial portion of said coupling ring having an inner circumferential surface of a slightly conically widening shape.

* * * * *